United States Patent [19]

Faurel et al.

[11] Patent Number: 5,022,380

[45] Date of Patent: Jun. 11, 1991

[54] OVEN WITH DOUBLE DOOR

[75] Inventors: Jacques Faurel, Meythet; Raymond Violi, Marlens, both of France

[73] Assignee: Societe Cooperative de Production Bourgeois, Faverges, France

[21] Appl. No.: 438,577

[22] Filed: Nov. 17, 1989

[30] Foreign Application Priority Data

Nov. 17, 1988 [FR] France ..... 88 15208

[51] Int. Cl.[5] ..... F23M 7/00; F24C 1/00

[52] U.S. Cl. ..... 126/190; 126/198; 126/200; 110/173 R; 110/180

[58] Field of Search ..... 126/190, 198, 200, 545; 110/173 R, 173 B, 180

[56] References Cited

U.S. PATENT DOCUMENTS

| | | | |
|---|---|---|---|
| 3,234,899 | 2/1966 | Mueller | 110/173 R |
| 4,048,978 | 9/1977 | Plumat et al. | 126/200 |
| 4,638,788 | 1/1987 | Lancelot | 126/190 X |
| 4,883,002 | 11/1989 | Shuster | 126/190 X |

FOREIGN PATENT DOCUMENTS

| | | |
|---|---|---|
| 0183559 | 6/1986 | European Pat. Off. . |
| 1906621 | 9/1970 | Fed. Rep. of Germany . |
| 2474654 | 7/1981 | France . |
| 740652 | 8/1953 | United Kingdom . |
| 864816 | 4/1961 | United Kingdom . |

*Primary Examiner*—Larry Jones

*Attorney, Agent, or Firm*—Ratner & Prestia

[57] ABSTRACT

An oven with double door is disclosed formed of a rigid projecting frame which supports, through guide rods, an inner plate which is urged by springs. Closure is provided by the inner plate which slides with respect to the frame and supports a peripheral seal.

13 Claims, 3 Drawing Sheets

OVEN WITH DOUBLE DOOR

BACKGROUND OF THE INVENTION

1. Field of the Invention

The present invention relates to ovens, such as ovens for cooking foods, having an opening which can be closed by a hinged door.

2. Description of the Prior Art

In traditional ovens, the door is a rigid frame hinged along one of its sides to the edge of the oven enclosure. A peripheral seal provides sealing between the inner face of the door and the enclosure in the closed position. The door generally has a central wall made from a transparent material, surrounded by the frame to which it is fixed.

A first problem which is raised in traditional ovens is the rise in temperature of the door, which is in contact with the oven enclosure and heats up by conduction. The central part of the door forms directly an enclosure limiting wall and heats up by radiation and convection. Thus, for manipulating the door external handles are provided which are sufficiently insulated thermally from the rest of the door. Apart from the space required and aesthetic drawbacks inherent in such external handles, it will be readily understood that the relatively high temperature of the door itself forms a dangerous element since the user may touch the door accidentally.

Furthermore, in traditional ovens, it is observed that the door frame, very often made from metal, tends to be deformed and to buckle because of the temperature, so that closure becomes defective. Such a structure is unsuitable for complying with the severe sealing requirements in modern ovens in which cooking may be steam cooking.

A second problem raised in traditional ovens is the difficulty of obtaining sufficient sealing between the oven door and the oven enclosure, particularly in steam ovens. In fact, it is necessary to prevent steam from escaping during operation of the oven. Such sealing is made difficult by the differential expansion between the oven door and enclosure.

One attempt to solve the sealing problem is described, for example, in the document DE-A-1 906 621. In this approach, the oven door comprises:

a rigid outer wall hinged along a first side to a first edge of the enclosure, a first plate, of a size slightly greater than the opening of the enclosure, formed so as to fit over the enclosure opening and close it in the closed position, the inner plate being movably fixed to the outer wall opposite its inner face, to which it is connected by connection means allowing the relative movement of the inner plate perpendicularly to the outer wall, between two relative limit positions defined by stop means. The connection means comprise resilient means urging the inner plate away from the outer wall so as to apply it in the closed position against the front face of the enclosure. A seal is provided between the outer plate and the front face of the enclosure so as to provide sealing in the closed position.

Such a structure is adapted for improving sealing at the level of the peripheral seal between the inner plate and the oven enclosure, but does not solve the problem of total sealing of the door. In fact, the inner plate is fixed to the outer wall by rods, a first end of which is fixed rigidly to the outer wall and the second end of which has a head forming an end of travel stop, the rod being mounted for sliding in an aperture of the inner plate. The steam contained in the enclosure may thus escape about the aperture around the rod.

Moreover, such a structure is not suitable for obtaining correct cooling of the outer wall of the door, for the inner plate comprises parts in contact with the outer wall and the air contained between the inner plate and the outer plate heats up rapidly by conduction through the plate and heats up the outer wall.

SUMMARY OF THE INVENTION

The problem which the invention proposes solving is to provide a sealed oven enclosure, compatible with steam cooling, while providing a possibility of partial opening of the door, in the case of an internal overpressure in the oven enclosure, under satisfactory safety conditions. In such a case of internal overpressure, resulting for example from accidental combustion of material in the oven enclosure, or from voluntary accelerated cooling of the oven by vaporization of water, the door allows steam to escape which is channelled along the sides and rapidly cooled, without producing a high speed jet, without opening of the door and without destruction of the door. Simultaneously, the outer door portion is correctly insulated from the inner atmosphere of the oven enclosure, so that its temperature is relatively low.

Another object of the invention is to provide efficient protection of the hot parts of the oven particularly of the peripheral portion of the internal closure plate of the oven. Such protection prevents the user from accidentally gripping the edges of the inner plate, this plate being particularly hot at the time of opening of the oven. Such protection also prevents the user from accidentally knocking against the plate edges, with the consequent risk of breaking it or its fixing means.

An object of the invention is to allow rapid cooling of the oven by injection of water inside the enclosure. Such injection causes a violent release of steam and so a sudden overpressure in the enclosure. It is then necessary to provide controlled escape of steam out of the enclosure and the invention makes such escape possible through the door.

A difficulty met with in known ovens is the condensation of water on the inner wall of the door, particularly in steam ovens, for the door is relatively cold with respect to the rest of the oven and the steam condenses thereon. This causes not inconsiderable water flow and often an accumulation of water between the enclosure and the door above the seal. On opening the door, this water flows suddenly and may cause burning when it is still relatively hot.

Another advantage obtained by certain particular embodiments of the invention is to provide closure such that the condensation water which may form on the door wall flows inside the enclosure and does not remain between the door and the enclosure until the door is opened.

To attain these aims as well as others, the enclosure door of the invention comprises:

a rigid outer wall hinged along a first side to a first edge of the enclosure, a seal providing sealing between the inner plate and the front face of the enclosure in the closed position, an inner plate, whose dimensions are slightly greater than the opening of the enclosure, adapted so as to fit over the enclosure opening and close it in the closed position, movably disposed in front of the inner face of the outer wall, to which it is connected by connecting means allowing the relative movement of the inner plate with respect to the outer wall for their relative movements towards or away from each other between two relative limit positions defined by stop means, the connecting means comprising resilient means urging the inner plate away from the outer wall and applying it, in the closed position, against the front face of the enclosure.

According to the invention:

the outer wall is provided with engagement means for selective locking thereof in the closed position, the inner plate is continuous, providing total sealing in the closed position, the connection between the inner plate and the connecting means introducing no possible passage between the inside and the outside of the enclosure, the outer wall has larger dimensions than the inner plate and comprises a peripheral portion which extends beyond the contour of the inner plate and which forms a protective flange whose edge is opposite the front face of the enclosure, passages are provided between the outer wall edges and the front face of the enclosure so as to permit natural air convection between the outer wall and the inner plate and to allow the steam to leave and be cooled and prevent its progression towards the front when the gas pressure prevailing inside the enclosure is sufficient to move the inner plate towards the outer wall against resilient means.

In one embodiment, the inner plate is made from transparent glass. In this case, closure is satisfactory whatever the temperature conditions, for deformation of the glass plate during a temperature rise is negligible. In addition, the user may see the inside of the enclosure when the door is closed, through a part of the central transparent material wall of the door and the inner transparent glass plate.

The inner plate may advantageously comprise a layer for reflecting the infrared rays towards the inside of the enclosure, in the case of a glass plate, the layer for reflecting the infrared rays is advantageously applied to its outer face, i.e. its face opposite the door wall. The reflecting layer is thus protected and yet efficiently reflects the infrared rays coming from inside the oven.

In one embodiment, the connection means between the inner plate and the outer wall of the door comprise guide rods fixed perpendicularly in the vicinity of the edges of the plate and sliding in corresponding passages in the outer wall of the door, each rod being urged by a spring pushing it away from the outer wall towards an end of travel stop.

BRIEF DESCRIPTION OF THE DRAWINGS

Other objects, features and advantages of the present invention will be clear from the following description of particular embodiments, with reference to the accompanying figures in which.

DESCRIPTION OF THE PREFERRED EMBODIMENTS

Figure 1:
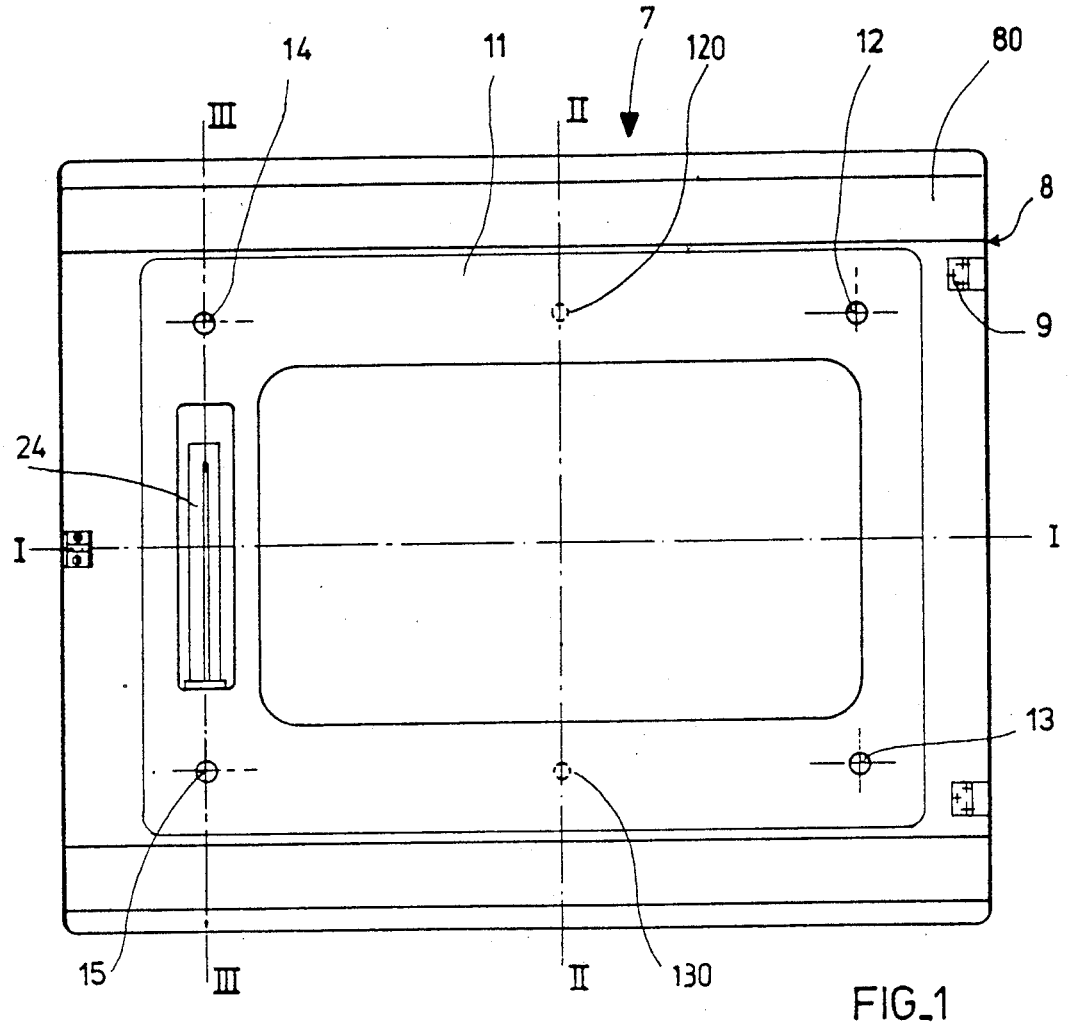
FIG. 1 is an elevational view of the inner face of an enclosure door in accordance with the present invention.

In the embodiment shown in the figures, an enclosure 1 such as an oven enclosure is defined by an upper wall 2, a lower wall 3, two side walls 4 and 5, a bottom, not shown in the figures, and has an opening 6 opposite the bottom. A door 7 is provided for closing the opening 6 of enclosure 1. The door 7 comprises, in this embodiment, an outer wall 8 formed of a rigid frame 80, for example made from metal, hinged along a first vertical side 9 to the side wall 4 of enclosure 1, in the vicinity of the edge of opening 6. The rigid frame 80 surrounds a central wall 10 to which it is fixed. The central wall 10 is a plate made from a transparent material such as glass.

Figure 2:
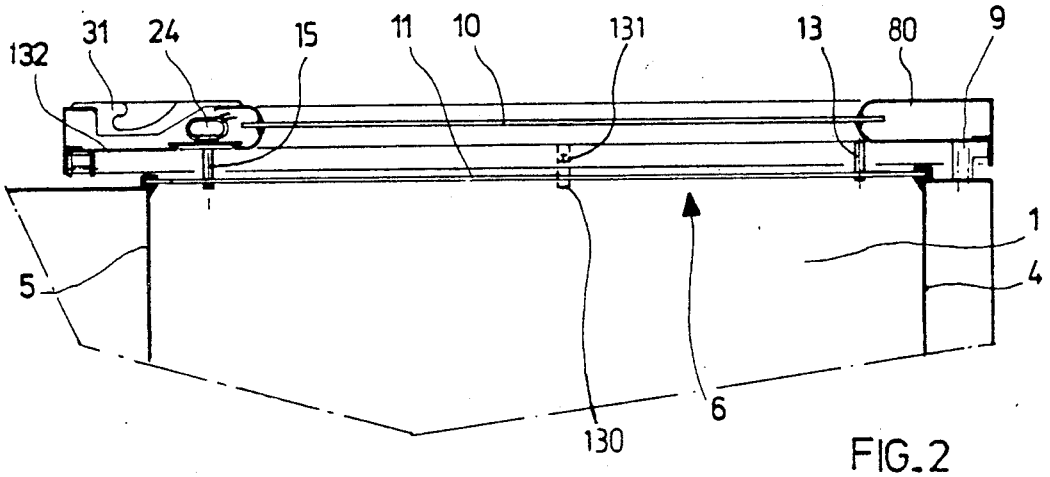
FIG. 2 is a top view in section through plane I—I of FIG. 1 showing a door fitted to an enclosure in accordance with the invention.
Figure 3:
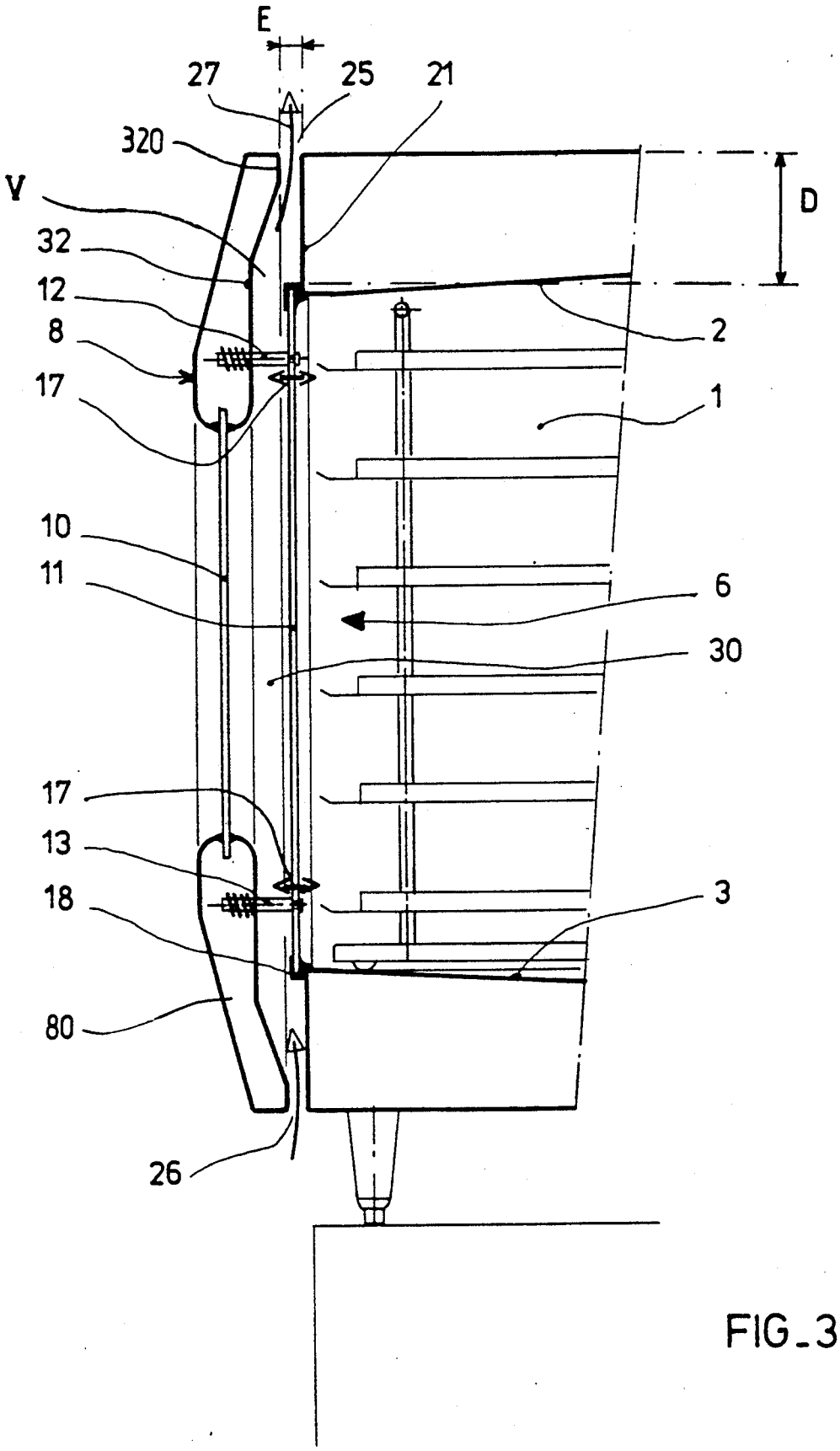
FIG. 3 is a side view in section through plane II—II of FIG. 1, showing a door fitted to an enclosure, in the closed position.
Figure 4:
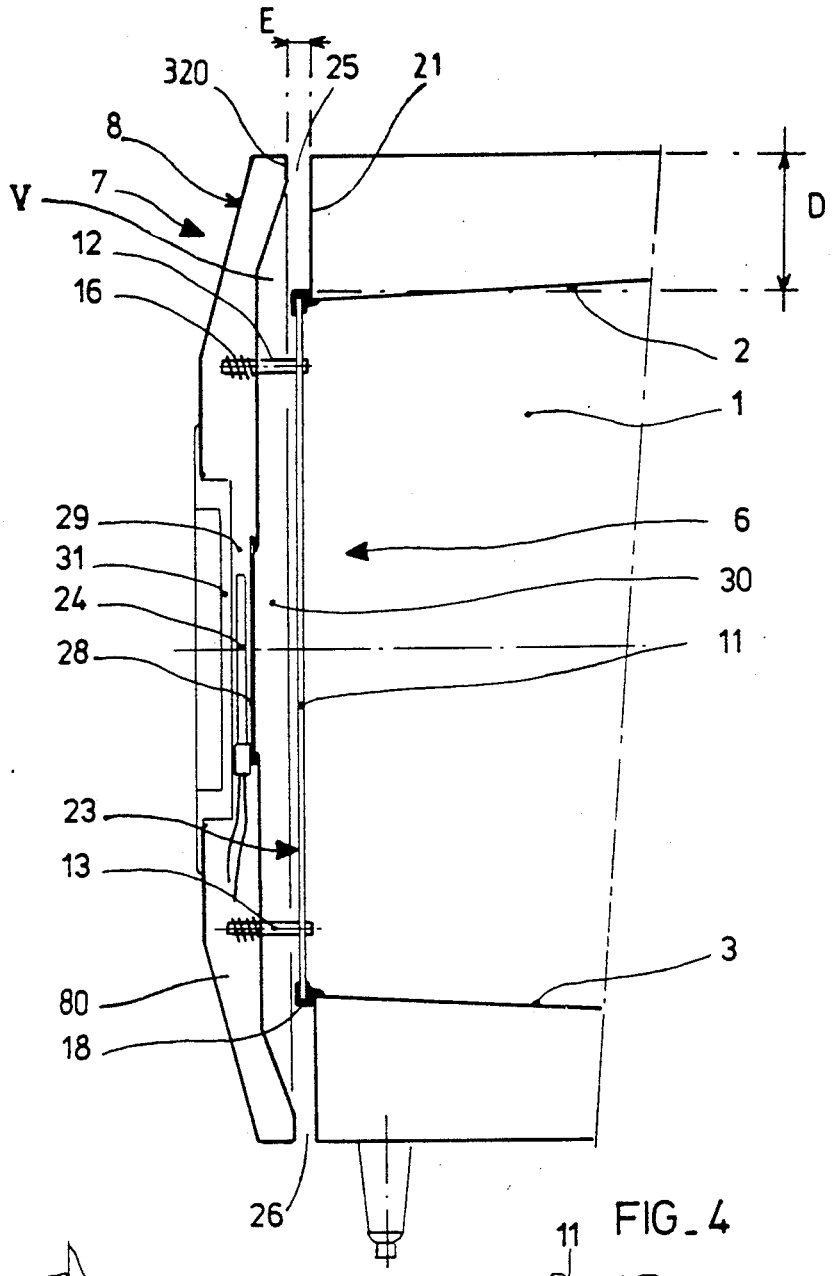
FIG. 4 is a side view in section through plane III—III of FIG. 1, showing a door in accordance with the invention fitted to an enclosure, in the closed position.

The door in accordance with the invention further comprises an inner plate 11, adapted so as to fit over opening 6 of enclosure 1 and close it in the closed position, as shown in FIGS. 2 to 4. The inner plate 11 comprises guide rods such as rods 12, 13, 14 and 15, fixed perpendicularly to the plate in the vicinity of its edges. For example, for a rectangular plate 11, such a rod 12, 13, 14 or 15 is disposed in the vicinity of each corner of the plate. Alternately, a rod 120 or 130 is disposed in the middle of each edge of inner plate 11 perpendicular to the first side 9 of outer wall 8. The rods are fixed to plate 11 at one of their ends and are housed and slide in corresponding passageways of the door frame 80, as shown in the figures. Each rod is urged by a spring, such as spring 16 associated with rod 12, spring 16 urging rod 12 away from frame 80, the movement of the rod being limited by a stop not shown in the figures.

Thus, the inner plate 11 is movable with respect to the outer wall 8, by the sliding of rods 12 to 15 and compression of the springs, as shown by the double arrow 17.

In the embodiment shown in the figures, plate 11 has a contour whose dimensions are very close to the dimensions of the enclosure opening 6, and is disposed so that in the closed position the inner plate contour is applied against the enclosure opening contour with interpositioning of a seal 18.

The seal surrounds the contour of the inner plate 11. For that it comprises an inner groove 180 in which is inserted the peripheral edge of the inner plate 11.

During closure of the door, the inner plate 11 abuts against the front face 21 of enclosure 1 surrounding the contour of opening 6 and is held in position by springs 16 compressed between said inner plate 11 and the door frame 80. The outer wall 8 of the door is itself provided with engagement means for selective locking thereof on the oven enclosure in the closed position. The engagement means may be of any currently used type, and are therefore not shown in the drawings. If an internal overpressure greater than a predetermined threshold occurs inside the enclosure, the pressure moves the inner plate 11 slightly towards door 7 against the force of springs 16, so that the gases or vapors may escape towards the outer atmosphere between plate 11 and the edges of the opening 6 of enclosure 1.

Figure 5:
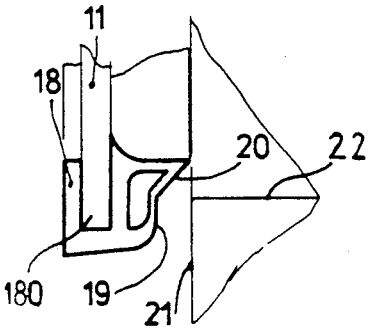
FIGS. 5 and 6 show the deformation of the seal of the invention, at the time of closure.
Figure 6:
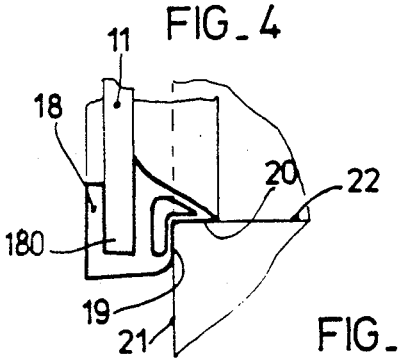

In FIGS. 5 and 6 the constructional detail of a seal 18 according to an advantageous embodiment has been shown. The seal comprises an outer flange 19 and an inner flange 20, defining a cross section having the general shape of an L. In the closed position, shown in FIG. 6, the inner flange 20 bears against the inner face 22 of the edge of the enclosure opening, whereas the outer flange 19 bears against the front face 21 of the edge of the enclosure opening.

Advantageously, the seal is a hollow deformable shaped piece, as shown in FIGS. 5 and 6, so that, when the outer flange 19 bears against the front face 21 of the enclosure opening edge, the seal is deformed and its inner flange 20 moves radially and is applied against the inner face 22 of the enclosure opening. As long as the outer flange 19 is not applied against the enclosure opening edge, the inner flange 20 of the seal is offset towards the center of the door, facilitating introduction of the seal inside the enclosure opening 6 when the door is closed. The fact that the inner flange 20 of seal 18 penetrates inside the enclosure opening 6 facilitates the channelling of condensation water towards the inside of the enclosure, preventing water leaving when the door is opened.

The inner plate 11 is advantageously made from a glass plate comprising an infrared ray reflecting layer. Preferably, the reflecting layer is applied against the outer face 23 of plate 11. A plate may for example be used made from a material sold commercially under the trademark "Thermax" by the firm Schott.

A light source such as a luminescent tube 24 is disposed in the door, carried by frame 80, outside the inner plate 11. The luminescent tube 24 is thus protected from the high temperature prevailing inside enclosure 1, by the interposed inner plate 11. An additional transparent protective plate 28 is further adapted for closing the door housing 29 in which the luminescent tube 24 is placed.

A hollow zone 31 serving as handle is formed in the outer face of the door frame 80, in the vertical upright 132 opposite the hinge.

The outer wall 8 has larger dimensions than the inner plate 11 and comprises a peripheral portion which extends beyond the contour of the inner plate 11, and which forms a protective flange whose edge, such as edge 320, is opposite the front face 21 of the enclosure. The space separating edges 320 and the front face 21 define passageways 25 and 26 whose thickness E is advantageously between 0.5 and 3 cm. The edges of outer wall 8 extend beyond the contour of the inner plate 11 over a distance D greater than 5 cm. The inner face 32 of outer wall 8 remains relatively spaced away from the plane of the inner plate 11 over all or part of distance D so as to define an expansion volume V surrounding the periphery of the inner plate 11. The depth of volume V is advantageously greater than a centimeter, its width being greater than 4 cm. Thus, when steam escapes from the enclosure, pushing the inner plate 11 back, the steam flows in a turbulent flow in volume V, then escapes through the side passages such as passages 25 and 26, in which it is guided by the cold inner face 32 of the outer wall 8 and the front face 21 of the enclosure, which rapidly cools the steam and prevents its forward progression towards the front of the oven.

In an advantageous embodiment, the escape of steam may be privileged along one of the sides of the inner plate 11, for example the upper side. That is obtained by choosing springs such as spring 16 with appropriate stiffness: the springs close to the privileged side must have a lower stiffness than the springs close to the opposite side.

The passages 25 and 26 formed between the frame 80 of outer wall 8 and front face 21 of enclosure 1 further allow a flow of air between the frame and the enclosure walls as shown by arrow 27. The air flows between the outer atmosphere and space 30 formed between the inner plate 11 and the inner face 32 of outer wall 8. Under the usual conditions of use, with door 7 closed, space 30 advantageously has a thickness of about 1 cm. This air flow promotes cooling of the central wall 10 of the door and frame 80. The passageways 25, 26 may advantageously be formed respectively in the lower part and in the upper part of the junction between frame 80 and enclosure 1 so as to take advantage of the chimney effect and promote air flow between the outer wall and the enclosure.

In the embodiment shown in the figures, the outer wall 8 advantageously has a form in which door 7 is curved, its inner face 32 opposite the enclosure opening 6 being hollow. In this arrangement. the inner plate 11 is housed in the hollow formed by the inner face 32 of door 7, is surrounded by the expansion volume V and is thus protected along its periphery by the frame 80. The edges of frame 80 form a protective flange for the inner plate 11. Thus, mechanical protection of the inner plate 11 is provided, in particular preventing the inner plate 11 from being engaged and moved laterally in its plane, in which direction of movement rods 12 to 15 have a lower mechanical strength. Thus, the user cannot touch the hot edges of the inner plate 11 when the oven is opened.

Preferably, when four rods 12 to 15 are used, the inner plate 11 is fixed to rods 12 to 15 in a removable way, so that the user may readily separate plate 11 from the rods for cleaning its outer face 23 and for cleaning the inner face 32 of outer wall 8.

The embodiment may be preferred in which the inner plate 11 is fixed by only two rods 120 and 130 in the middle of two opposite sides perpendicular to the first side 9 of outer wall 8, namely perpendicular to the hinge. In this case, a possibility may be advantageously provided of pivoting the inner plate 11 about the median axis II—II perpendicular to the two rods 120 and 130. Such a possibility of pivoting may be provided by hinges such as hinge 131, with axis II—II, formed in the intermediate part of rods 120 and 130. In this case the flanges of outer wall 8 are spaced fairly far apart from the edges of inner plate 11 so as to leave a sufficient volume V between the edges of inner plate 11 and the inner wall 32 of frame 80. In this case, by pivoting the inner plate 11, access to space 30 between the inner plate 11 and the outer wall 8 is freed, for example for cleaning the walls.

The present invention is not limited to the embodiments which have been explicitly described, but includes the different variants and generalizations thereof contained within the following claims.

What is claimed is:

1. An enclosure such as an oven having a first edge, a front face, and an opening which can be closed by a hinged door, said door comprising:

a rigid outer wall hinged along a first side to the first edge of the enclosure including:

(a) an inner face, (b) means for engaging the enclosure to selectively lock the outer wall in the closed position, (c) a peripheral portion forming a protective flange whose edge is opposite the front face of the enclosure, and (d) edges which define passages between the outer wall and the front face of the enclosure;

a rigid continuous inner plate, whose dimensions are slightly greater than the opening of the enclosure and smaller than the outer wall so that the peripheral portion of the outer wall extends beyond the contour of the inner plate, adapted so as to fit completely over the enclosure opening and sealingly close it in the closed position, movably disposed so as to be able to move away from the inner face of the outer wall;

means for connecting the inner plate to the outer wall with a space defined therebetween, the connecting means comprising:

(a) at least two guide rods fixed perpendicularly to the inner plate at one of their ends and slidingly housed in corresponding passages in the outer wall, (b) resilient means for urging the rods and the inner plate away from the outer wall and applying the inner plate against the front face of the enclosure in the closed position, and (c) means for stopping relative movement of the inner plate towards or away from the outer wall between two relative limit positions by limiting movement of the rods, whereby the passages between the outer wall and the front face of the enclosure permit natural air convection in the space formed between the outer wall and the inner plate to guide and cool the outgoing steam when the gas pressure prevailing inside the enclosure is sufficient to move the inner plate towards the outer wall against the resilient means;

a seal providing sealing between the inner plate and the front face of the enclosure in the closed position; and a connection between the inner plate and the connecting means which does not allow the passage of steam between the inside and outside of the enclosure.

2. The enclosure as claimed in claim 1, wherein said resilient means includes a spring engaging each rod and said at least two guide rods fixed perpendicularly to said inner plate are positioned adjacent at least two opposite edges of the plate.

3. The enclosure as claimed in claim 2, wherein said connecting means comprise four guide rods fixed to the vicinity of the four corners of the inner plate and sliding in four corresponding passages in the outer wall.

4. The enclosure as claimed in claim 2, wherein said connecting means comprise only two guide rods fixed respectively to the middle of each of the edges of the inner plate perpendicular to the first side of the outer wall, said rods comprising hinges allowing the inner plate to pivot about a median axis perpendicular to the two rods.

5. The enclosure as claimed in claim 1, wherein an expansion volume is formed between the edges of the outer wall and the inner plate contour.

6. The enclosure as claimed in claim 1, wherein said resilient means have different stiffnesses for privileging the outlet of steam along one of the sides of the inner plate.

7. The enclosure as claimed in claim 1, wherein:

said inner plate is made from transparent glass, said outer wall comprises a rigid frame surrounding a transparent central wall.

8. The enclosure as claimed in claim 1, wherein said seal surrounds the contour of the inner plate.

9. The enclosure as claimed in claim 8, wherein said seal comprises an outer flange and an inner flange, said outer flange bearing against the front face of the edge of the enclosure opening when the door is in the closed position, the inner flange of the seal then bearing against the inner face of the enclosure opening.

10. The enclosure as claimed in claim 9, wherein said seal is a hollow shaped piece which is deformable so that, when the outer flange of the seal bears against the front face of the enclosure, the seal is deformed and its inner flange moves radially and is applied against the inner face of the enclosure opening.

11. An enclosure such as an oven having a first edge, a front face, and an opening which can be closed by a hinged door, said door comprising:

a rigid outer wall hinged along a first side to the first edge of the enclosure including:

(a) an inner face, (b) means for engaging the enclosure to selectively lock the outer wall in the closed position, (c) a peripheral portion forming a protective flange whose edge is opposite the front face of the enclosure, and (d) edges which define passages, having a thickness between 0.5 and 3 cm, between the outer wall and the front face of the enclosure;

a rigid continuous inner plate, whose dimensions are slightly greater than the opening of the enclosure and smaller than the outer wall so that the peripheral portion of the outer wall extends beyond the contour of the inner plate by a distance greater than 5 cm, adapted so as to fit completely over the enclosure opening and sealingly close it in the closed position, movably disposed so as to be able to move away from the inner face of the outer wall;

means for connecting the inner plate to the outer wall with a space defined therebetween, the connecting means comprising:

(a) at least two guide rods fixed perpendicularly to the inner plate at one of their ends and slidingly housed in corresponding passages in the outer wall, (b) resilient means for urging the rods and the inner plate away from the outer wall and applying the inner plate against the front face of the enclosure in the closed position, and (c) means for stopping relative movement of the inner plate towards or away from the outer wall between two relative limit positions by limiting movement of the rods, whereby the passages between the outer wall and the front face of the enclosure permit natural air convection in the space formed between the outer wall and the inner plate to guide and cool the outgoing steam when the gas pressure prevailing inside the enclosure is sufficient to move the inner plate towards the outer wall against the resilient means;

a seal providing sealing between the inner plate and the front face of the enclosure in the closed position; and a connection between the inner plate and the connecting means which does not allow the passage of steam between the inside and outside of the enclosure.

12. An enclosure such as an oven having a first edge, a front face, and an opening which can be closed by a hinged door, said door comprising:

an outer wall hinged along a first side to the first edge of the enclosure including:

(a) a rigid frame, (b) a transparent central wall surrounded by the rigid frame, (c) an inner face, (d) means for engaging the enclosure to selectively lock the outer wall in the closed position, (e) a peripheral portion forming a protective flange whose edge is opposite the front face of the enclosure, and (f) edges which define passages between the outer wall and the front face of the enclosure;

a continuous inner plate of transparent glass, whose dimensions are slightly greater than the opening of the enclosure and smaller than the outer wall so that the peripheral portion of the outer wall extends beyond the contour of the inner plate, adapted so as to fit completely over the enclosure opening and sealingly close it in the closed position, movably disposed so as to be able to move away from the inner face of the outer wall;

an infrared ray reflecting layer applied to the outer face of the inner plate;

means for connecting the inner plate to the outer wall with a space defined therebetween, the connecting means comprising:

(a) at least two guide rods fixed perpendicularly to the inner plate at one of their ends and slidingly housed in corresponding passages in the outer wall, (b) resilient means for urging the rods and the inner plate away from the outer wall and applying the inner plate against the front face of the enclosure in the closed position, and (c) means for stopping relative movement of the inner plate towards or away from the outer wall between two relative limit positions by limiting movement of the rods, whereby the passages between the outer wall and the front face of the enclosure permit natural air convection in the space formed between the outer wall and the inner plate to guide and cool the outgoing steam when the gas pressure prevailing inside the enclosure is sufficient to move the inner plate towards the outer wall against the resilient means;

a seal providing sealing between the inner plate and the front face of the enclosure in the closed position; and a connection between the inner plate and the connecting means which does not allow the passage of steam between the inside and outside of the enclosure.

13. An enclosure such as an oven having a first edge, a front face, and an opening which can be closed by a hinged door, said door comprising:

an outer wall hinged along a first side to the first edge of the enclosure including:

(a) a rigid frame, (b) a transparent central wall surrounded by the rigid frame, (c) an inner face, (d) means for engaging the enclosure to selectively lock the outer wall in the closed position, (e) a peripheral portion forming a protective flange whose edge is opposite the front face of the enclosure, and (f) edges which define passages between the outer wall and the front face of the enclosure;

a continuous inner plate of transparent glass, whose dimensions are slightly greater than the opening of the enclosure and smaller than the outer wall so that the peripheral portion of the outer wall extends beyond the contour of the inner plate, adapted so as to fit completely over the enclosure opening and sealingly close it in the closed position, movably disposed so as to be able to move away from the inner face of the outer wall;

a light source supported by the rigid frame and positioned outside the inner plate;

means for connecting the inner plate to the outer wall with a space defined therebetween, the connecting means comprising:

(a) at least two guide rods fixed perpendicularly to the inner plate at one of their ends and slidingly housed in corresponding passages in the outer wall, (b) resilient means for urging the rods and the inner plate away from the outer wall and applying the inner plate against the front face of the enclosure in the closed position, and (c) means for stopping relative movement of the inner plate towards or away from the outer wall between two relative limit positions by limiting movement of the rods, whereby the passages between the outer wall and the front face of the enclosure permit natural air convection in the space formed between the outer wall and the inner plate to guide and cool the outgoing steam when the gas pressure prevailing inside the enclosure is sufficient to move the inner plate towards the outer wall against the resilient means;

a seal providing sealing between the inner plate and the front face of the enclosure in the closed position; and a connection between the inner plate and the connecting means which does not allow the passage of steam between the inside and outside of the enclosure.

* * * * *